US005876290A

United States Patent [19]

Hermanson et al.

[11] Patent Number: 5,876,290

[45] Date of Patent: Mar. 2, 1999

[54] SHEET METAL PIN TABLE AND RESPOT ACTUATOR

[75] Inventors: Gerald P. Hermanson, King George; Ernest B. Pryor, Jr., Richmond; Winston T. Sanders, Chesterfield; Matthew E. Stubbs, Highland Springs, all of Va.

[73] Assignee: AMF Bowling, Inc., Mechanicsville, Va.

[21] Appl. No.: 873,566

[22] Filed: Jun. 12, 1997

[51] Int. Cl.[6] ..... A63D 5/09

[52] U.S. Cl. ..... 473/64

[58] Field of Search ..... 473/64, 65, 73, 473/83, 94, 103, 96

[56] References Cited

U.S. PATENT DOCUMENTS

| | | | |
|---|---|---|---|
| 983,956 | 2/1911 | Tisdale | 473/63 |
| 996,251 | 6/1911 | Hughes | 473/63 |
| 1,544,928 | 7/1925 | Olsen | 473/63 |
| 2,688,487 | 9/1954 | Montooth | 473/64 |
| 3,248,108 | 4/1966 | Congelli | 473/64 |
| 3,499,648 | 3/1970 | Huck et al. | 473/64 |
| 5,439,418 | 8/1995 | Stephens | 473/64 |

*Primary Examiner*—Theatrice Brown
*Attorney, Agent, or Firm*—Dougherty & Troxell

[57] ABSTRACT

A pin table for a bowling pin spotting/respotting device is fabricated from stamped sheet metal and has lips around the periphery of the sheet metal pin table, as well as around each of a plurality of pin openings through the pin table. The sheet metal pin table is generally planar in configuration and has a plurality of pin openings. The lips extend upwardly around the periphery of the pin table and around the periphery of each of the openings. The lips provide sufficient rigidity to the pin table to enable its manufacture from stamped sheet metal rather than a more expensive aluminum casting. A respot actuating assembly for use with the aforementioned table includes a respot cam link mechanism, a pair of crank arms and an adjustable stop mechanism for limiting rotation of the crank arms. Linkage connects the crank arms to the respot cam link mechanism and to multiple pairs of gripper rods for gripping and releasing a plurality of bowling pins.

9 Claims, 6 Drawing Sheets

SHEET METAL PIN TABLE AND RESPOT ACTUATOR

BACKGROUND OF THE INVENTION

The present invention relates to a pin table for a bowling pin spotter, more particularly, such a pin table stamped from sheet metal having rigidifying flanges around its periphery, as well as around the peripheries of openings in the pin table. The invention also relates to a respot actuator assembly for use with such tables or the like.

Automatic pin spotting/respotting devices are well known in the art and are typically located above the pin deck portion of a bowling alley. As is well known in the art, the pin spotter/respotter is associated with a bowling pin elevating system which removes the pins from a pit, located immediately behind the pin deck, into which the pins fall after having been knocked from the pin deck. The pin elevating mechanism elevates the pins from the pit and distributes them into the pin table in the bowling pin spotting/respotting device for subsequent spotting on the pin deck. The pin table is movable vertically relative to the pin deck so as to properly spot and re-spot the pins.

It is necessary for the pin table to be rigid so as to properly spot the bowling pins and to properly grip and pick up those pins which have not been knocked down so that they may be properly respotted. It is also important to have the pin table weigh as little as possible so as to minimize the overall weight of the spotting/respotting mechanism and to minimize the power necessary to raise and lower the pin table.

It is known to cast pin tables from aluminum. The known cast aluminum pin tables have integrally cast brackets for connection to the actuating mechanism and brackets for the pin gripping mechanisms. Needless to say, such intricate castings require complex and expensive dies (costing well over $250,000), thereby increasing the manufacturing costs.

Cost is an important factor in the highly competitive field of bowling pin spotting/respotting devices. Such devices are inherently complicated and complex, resulting in significant costs for the bowling alley proprietor. Therefore, a need exists for reducing the costs of the bowling pin spotting/respotting devices, while at the same time maintaining the rigidity and lightweight characteristics of the known pin tables.

SUMMARY OF THE INVENTION

The present invention relates to a pin table for a bowling pin spotting/respotting device fabricated from stamped sheet metal and which has lips around the periphery of the sheet metal pin table, as well as around each of a plurality of openings through the pin table to maximize the rigidity of the pin table. The sheet metal pin table is generally planar in configuration and has a plurality of pin openings therethrough to accommodate placement of the bowling pins. A rigidifying lip or flange extends upwardly around the periphery of the pin table, while a plurality of second lips, or flanges extend upwardly from the pin table around the periphery of each of the pin openings. The rigidifying flanges provide sufficient rigidity to the pin table to enable its manufacture from stamped sheet metal rather than a more expensive aluminum casting.

The pin table according to the present invention also includes a plurality of pairs of rods, each pair of rods extending substantially across one of the pin openings and a mechanism for opening and closing the distance between the pair of rods so as to grip and release bowling pins. A mechanism is also provided on the pin table for simultaneously opening or closing each of the pairs of pins via a single actuating link.

The invention also contemplates a pin table and actuating assembly in which the pin table includes a substantially flat or planar base having a plurality of openings therethrough. Means such as a plurality of rods or fingers are attached to the base member and extend across at least a portion of each of the openings for releasably holding a plurality of bowling pins. Actuating means including a cam link mechanism and a respot actuator bellcrank or crank arm are also provided. The respot actuator crank arm includes first and second respot actuator arms and an intermediate pivot which is fixed to and generally perpendicular to the base member. A first actuator arm connecting link operatively connects the first respot actuator arm to the cam link mechanism for rotating the respot actuator crank arm about the intermediate pivot in response to movement of the cam link mechanism. A second actuator connecting link then connects the second respot actuator arm to the means for releasably holding a plurality of bowling pins to thereby grasp and release the bowling pins in a neck portion thereof in response to movement by the cam link mechanism. Stop means are fixed with respect to the base member for limiting the rotation of the respot actuator crank arm to thereby limit the movement of the means for releasably holding the bowling pins.

DETAILED DESCRIPTION OF THE PREFERRED EMBODIMENT

Figure 1:
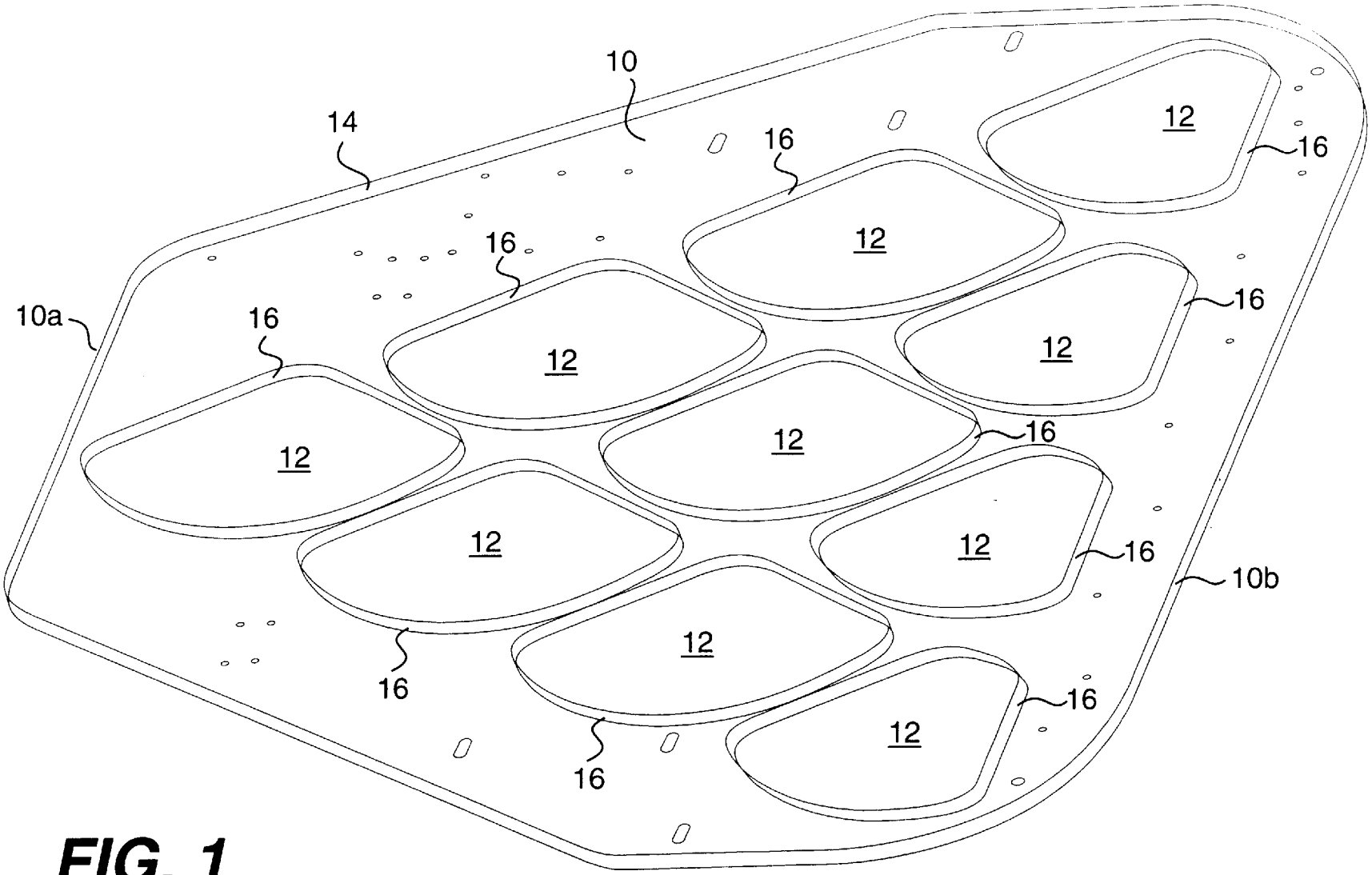
FIG. 1 is a perspective view of the stamped sheet metal pin table according to the present invention.

The stamped sheet metal pin table according to the present invention is illustrated in FIG. 1, wherein it can be seen that the pin table 10 is formed of a sheet metal material preferrably of hot rolled steel. It has been found that seven gauge sheet metal provides sufficient rigidity to be effectively utilized as a pin table. However, it is to be understood that this invention is not limited to the use of such a thickness of sheet metal. The thickness of the sheet metal will be dependent upon the particular usage and application of the pin table. The pin table 10 forms a plurality of pin openings 12, ten of which are illustrated in the figures. Although the invention will be described in conjunction with its usage as a pin table for a pin spotting/respotting device for ten-pin bowling, it is to be understood that other numbers of openings may be formed in the pin table without exceeding the scope of this invention.

As can be seen, each of the openings 12 has a plurality of sides and each opening has at least one arcuate side. The pin table 10 has a generally truncated triangular configuration and is substantially planar. First lip 14 extends around the periphery of the pin table 10 and may comprise a first flange extending upwardly from the pin table 10 substantially at 90° to the plane of the pin table 10. The pin table 10 also comprises a plurality of second lips 16, a second lip extending around the periphery of each of the pin openings 12. Again, each of the second lips 16 comprises a rigidifying flange extending from the plane of the pin table 10 at approximately 90°.

The pin table 10 is oriented with respect to the bowling alley with the truncated portion of the generally triangular configuration of the pin table 10, identified as 10*a* in FIG. 1, facing towards the foul line and is considered to be the front of the pin table. Correspondingly, the edge designated as 10*b* will face the pit of the bowling alley and is considered to be the rear of the pin table. Thus, it is quite evident from FIG. 1 that pin openings 12 are arranged in a generally triangular array, as are the bowling pins when they are spotted on the pin deck. In known fashion, the pin spotting/respotting device will place the pins above, or through the openings 12 such that when the pin table 10 is lowered, the pins will be properly spotted on the pin deck in their triangular array.

One of the functions of known pin spotting/respotting devices is to grip the pins remaining on the pin deck after the first bowling ball has been rolled and to raise these pins off the pin deck so that the barrier, or sweep, can remove the knocked-down pins from the alley and move them into the pit. Typically, gripping means are provided on the pin table for gripping a neck portion of the standing pins before the table is raised upwardly to enable the barrier to push the knocked down pins into the pit. These gripping means may comprise pairs of gripping rods located across each of the pin openings in the pin table which are actuated by an actuating mechanism such that the distance between the rods of each of the pairs of gripping rods may be closed and opened so as to grip and release the bowling pins.

Figure 2:
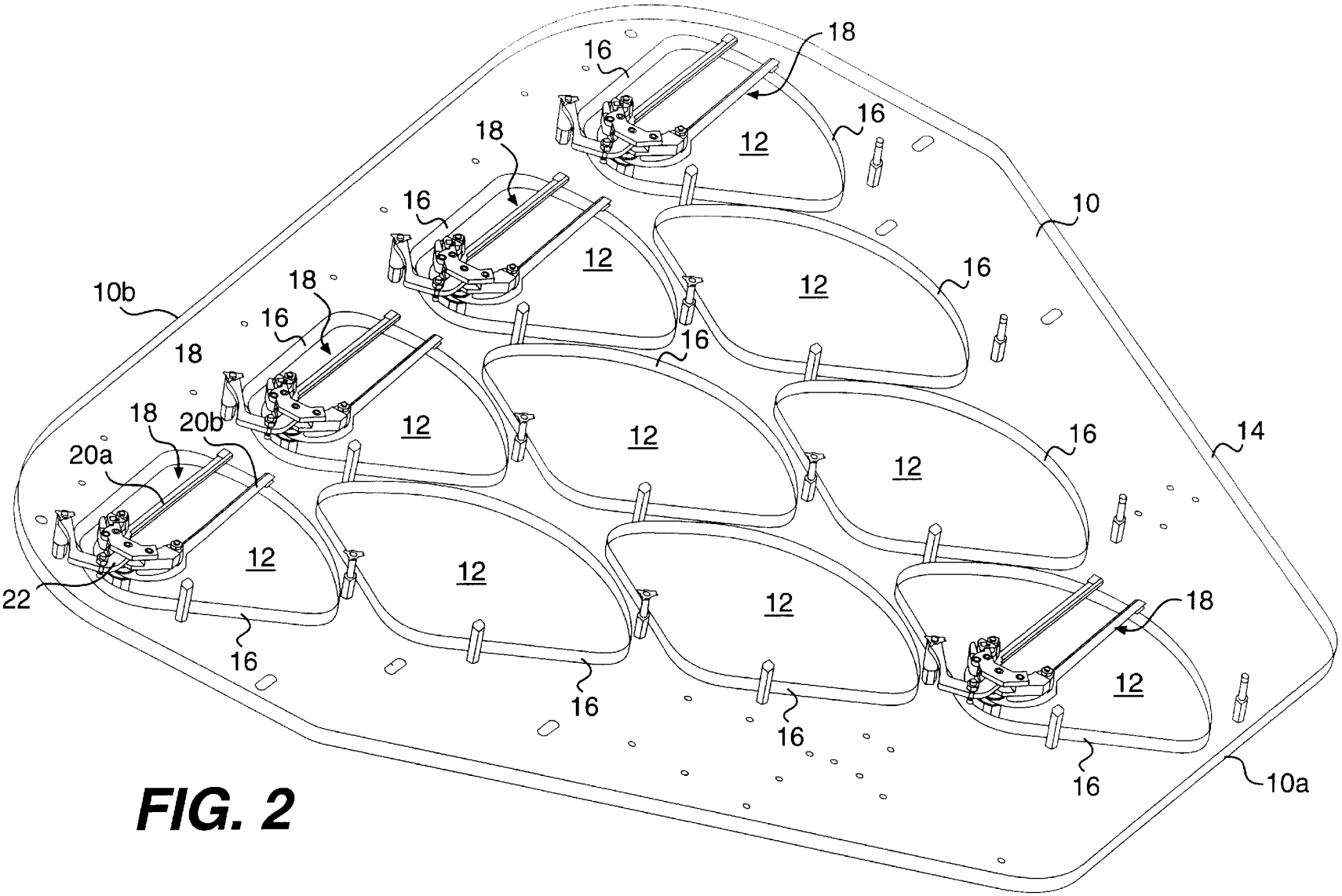
FIG. 2 is a perspective view of the pin table illustrated in FIG. 1 showing the pairs of pin gripping rods associated therewith.

As illustrated in FIG. 2, pairs of gripping rods 18 are pivotally attached to the pin table 10 and extend substantially across each of the pin openings 12. Although only five openings are illustrated in FIG. 2 having the gripping rods, it is to be understood that the pairs of gripping rods 18 extend substantially across each of the openings 12. Each pair of gripping rods 18 comprises first and second gripping rods 20*a* and 20*b* attached to a pivoting mechanism 22 which, in turn, is attached to the pin table 10. Such pivoting mechanisms are well known in the art and, per se, form no part of the present invention. Suffice to a say any such known pivoting mechanisms may be utilized with the present invention.

Figure 3:
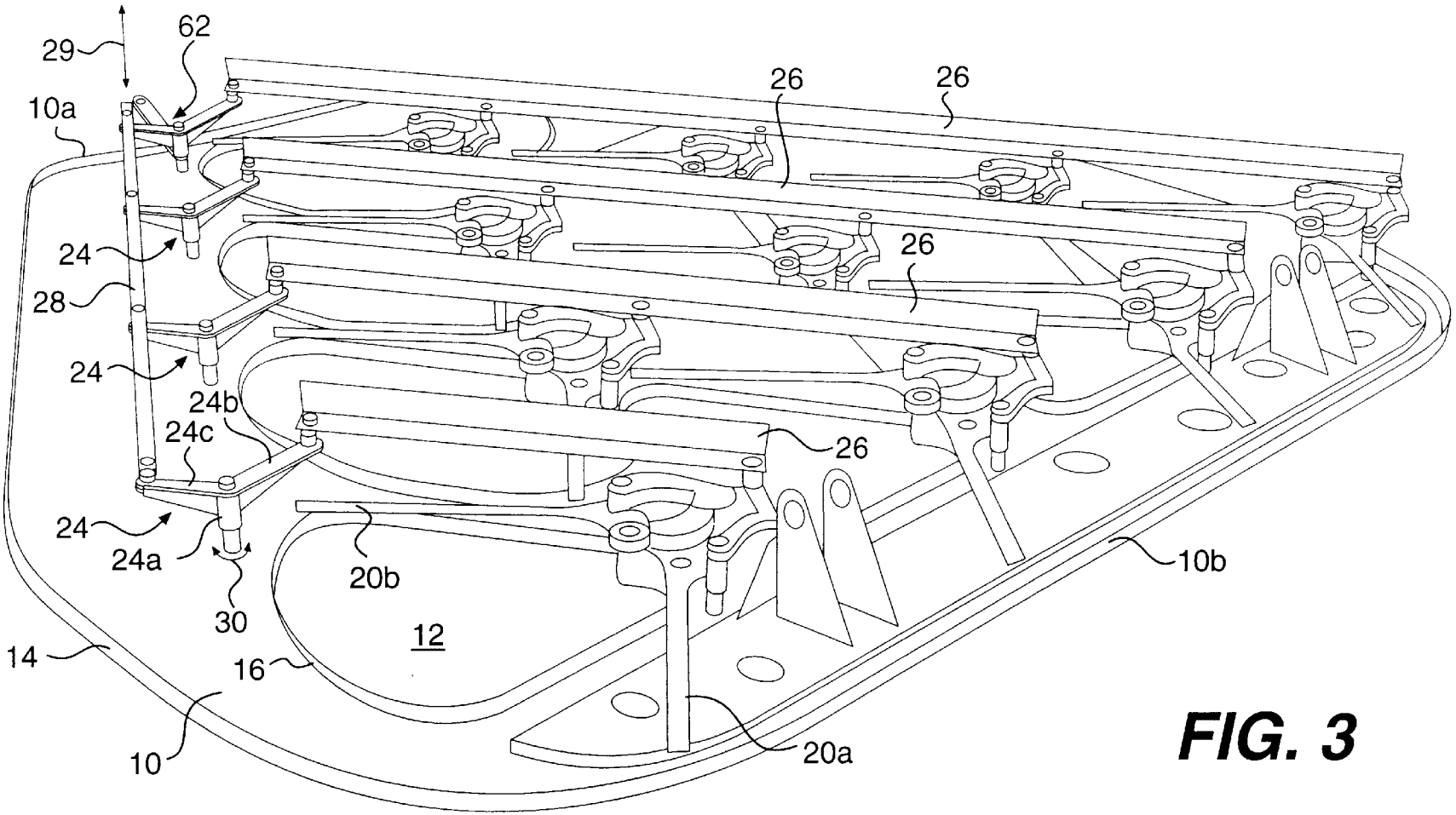
FIG. 3 is a perspective view of the pin table according to the present invention illustrating the actuating mechanism for the pin gripping rods.

The actuating mechanism for increasing and decreasing the distance between the gripping rods 20*a* and 20*b* for each of the pairs of rods 18 is illustrated in FIG. 3. The actuating mechanism comprises a plurality of bellcranks 24 each having a pivot body 24*a* pivotally attached to the pin table 10, and two arms 24*b* and 24*c* extending from the pivot body. A plurality of link members 26 are utilized in the actuating mechanism wherein each link member 26 has one end pivotally connected to arm 24*b* of one bellcrank 24 and is pivotally connected to the pivoting mechanism 22 of at least one pair of rods 18. Although link members 26 are illustrated as comprising an angle structure, quite obviously, other structural shapes and configurations may be utilized without exceeding the scope of this invention.

Arms 24*c* of each of the bellcranks 24 are pivotally connected to an actuating link 28 such that movement of actuating link 28 in the direction of arrows 29 causes pivoting movement of each of the bellcranks 24, which, in turn, causes movement of the gripping rods 20*a* and 20*b* of each of the pairs of rods 18 between a closed, or gripping, position illustrated in FIG. 2 and an open, or released, position illustrated in FIG. 3. The bellcranks are pivotally attached to the pin table 10 so as to pivot in the directions of arrow 31.

Figure 4:
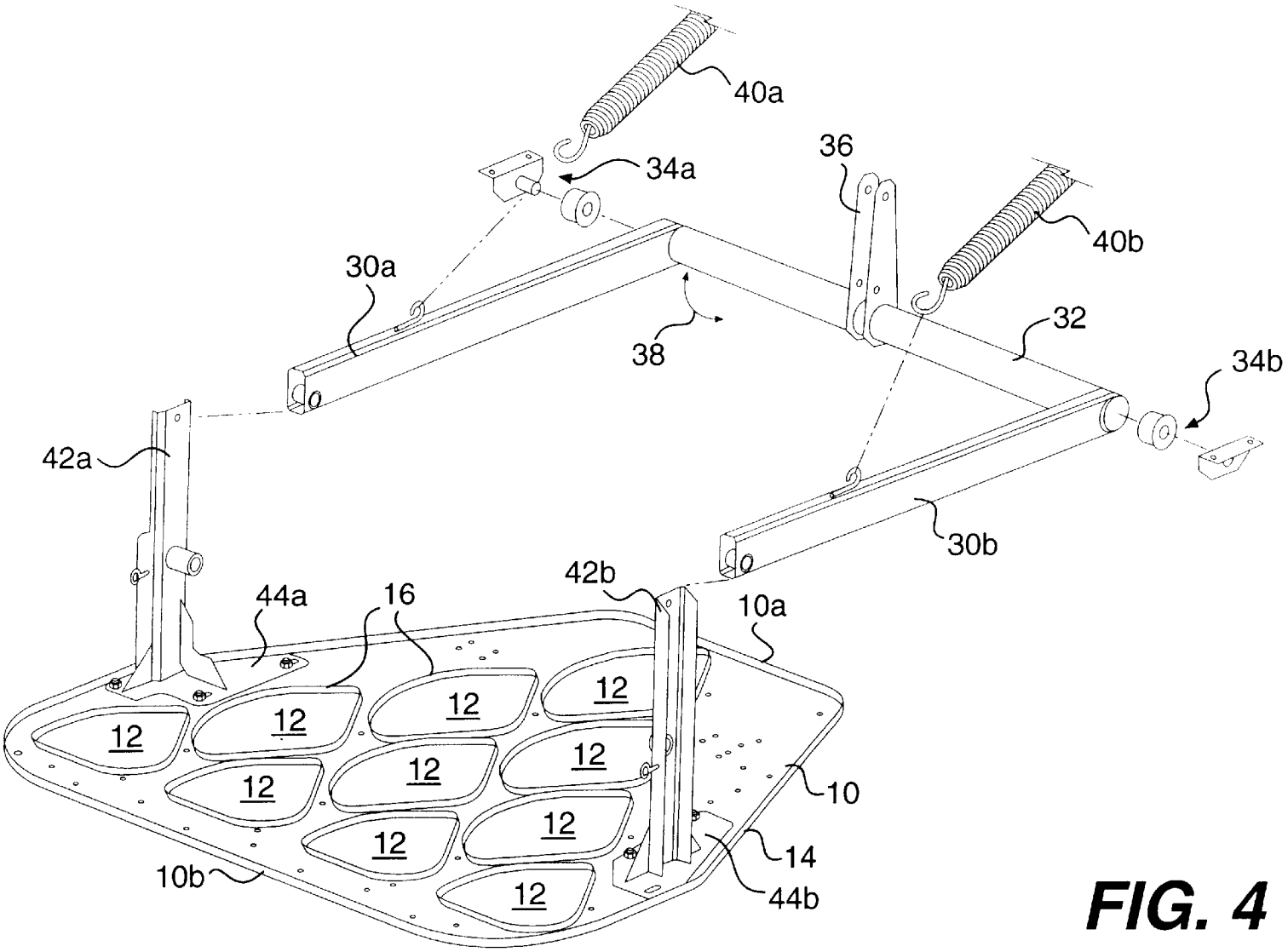
FIG. 4 is an exploded, perspective view of the stamped sheet metal pin table according to the present invention illustrating its connection to a pin table raising and lowering mechanism.

Known bowling pin spotting/respotting devices have means for generally vertically moving the pin table 10 with respect to the pin deck of the bowling alley. Although this mechanism, per se, forms no part of the instant invention, the pin table 10 must be connected to such a mechanism to perform its intended function. As illustrated in FIG. 4, the known elevating and lowering mechanisms may comprise a pair of arms 30*a* and 30*b* which are connected to shaft 32 that is rotatably attached to the pin spotting mechanism (not shown) by bearing assemblies 34*a* and 34*b*. A crank arm 36, affixed to pivoting rod 32 is connected to an actuating mechanism (not shown) to selectively cause the rod 32 to pivot about its longitudinal axis so as to move arms 30*a* and 30*b* in the directions of arrow 38. Counterbalance springs 40*a* and 40*b* may be connected to arms 30*a* and 30*b* and the pin spotting/respotting device (not shown) so as to minimize the force required to move the pin table.

The pin table 10 has connecting members 42*a* and 42*b* affixed thereto by brackets 44*a* and 44*b*, respectively. As can be seen in FIG. 4, the connecting members 42*a* and 42*b* extend substantially perpendicularly to the plane of the pin table 10 and extend from the same side of the pin table 10 as do lips 14 and 16. Connecting members 42*a* and 42*b* are pivotally attached to arms 30*a* and 30*b*, respectively, such that movement of the arms in the direction of arrows 38 will cause the pin table 10 to be raised or lowered with respect to the pin deck (not shown).

Figure 5:
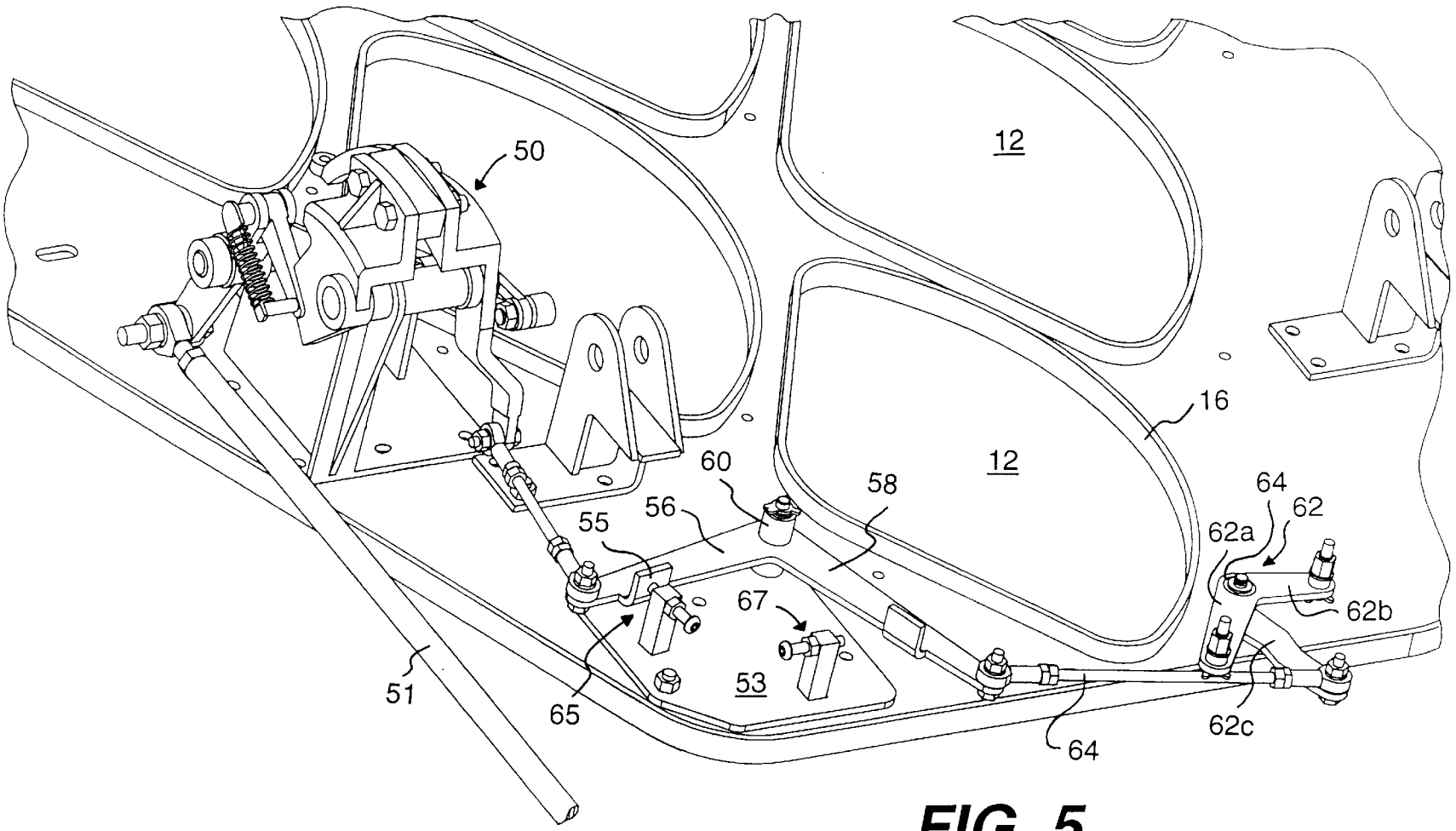
FIG. 5 is a perspective view of a pin table and actuating assembly according to the invention.
Figure 6:
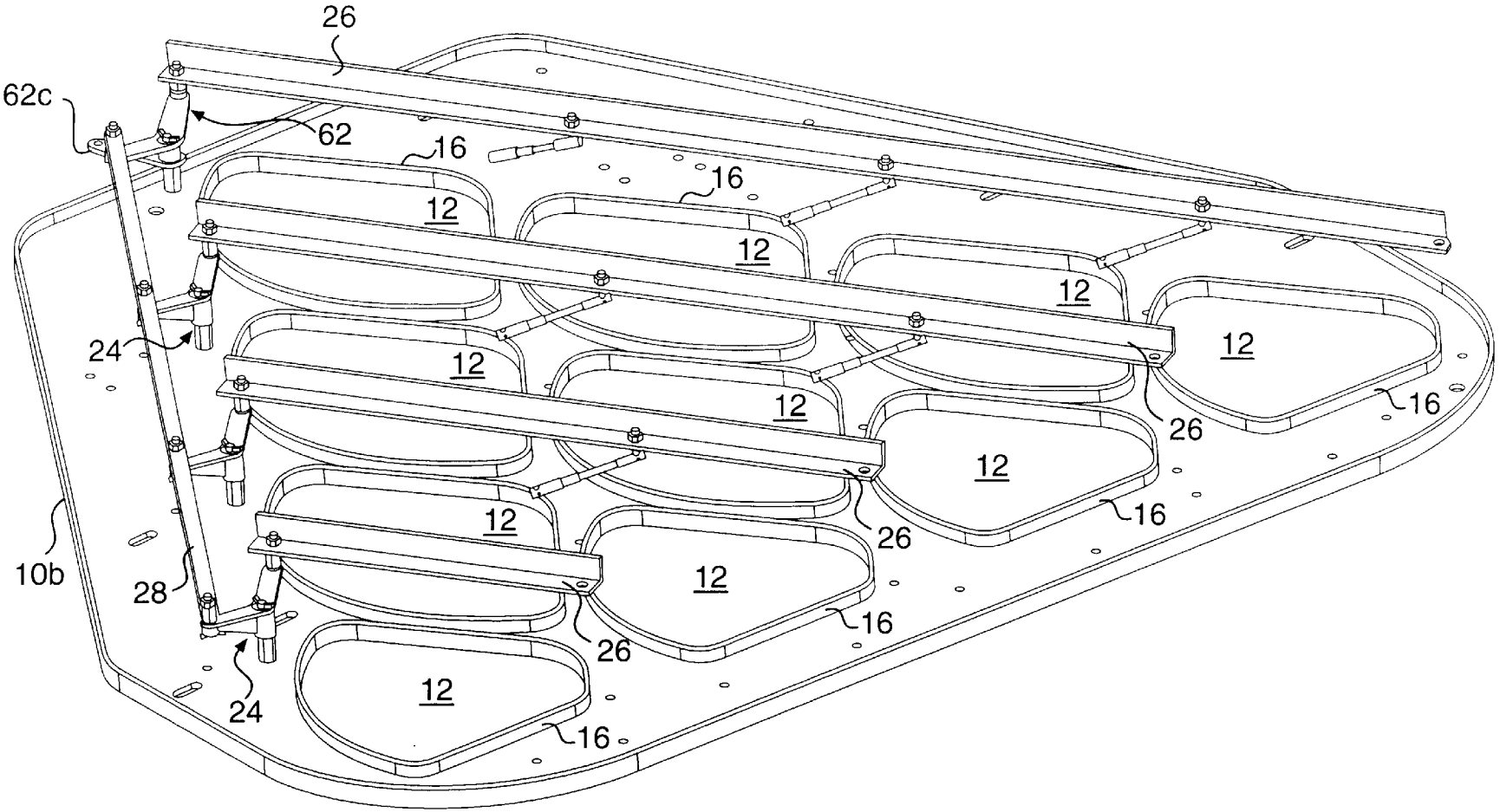
FIG. 6 is a perspective view of the pin table shown in FIG. 5 but simplified to better illustrate the actuating link members.

An actuator assembly as illustrated in FIGS. 5 and 6 includes a respot cam link mechanism 50 which is of a conventional design. The respot cam link mechanism 50 which is activated by a respot tie rod 51 is essentially identical to the respot cam link mechanism as used on a conventional cast aluminum table in the AMF models 8290 and 8800 pinspotters. The mechanism 50 is preferably identical to the earlier models so that a new pin table and actuating assembly can be installed in an existing system without replacing an existing cam link mechanism.

The respot cam link mechanism 50 is operatively connected to a first respot actuator arm 56 which is part of a respot actuator crank arm 52 by means of a connecting link 54. The respot actuator crank arm 52 also includes a second respot actuator arm 58 and an intermediate pivot 60 which is fixed to and generally perpendicular to a base plate 53.

The second respot actuator arm 58 is operatively connected to a respot connecting crank arm 62. The respot connecting crank arm 62 includes a first and second lever arms 62*a* and 62*b* as well as an intermediate pivot 64. The respot connecting crank arm 62 also includes a third lever or actuating arm 62*c* which is operatively connected to the connecting link 64 while the first and second lever arms 62*a* and 62*b* are each connected to link members 26 which act as an actuating mechanism for opening and closing the griping rods 18.

The respot actuator crank arm 52 also includes a pair of stops 55 and 57 which are fixed to or formed as part of the first and second respot actuator arms 56 and 58. A pair of adjustable stop members 55 and 67 are fixed to the base plate 53 for limiting the rotation of the respot actuator crank arm 52 by engagement with the stops 55 and 57.

It is important to limit the rotation of the respot connecting crank arm 62 to about 40° to open and close the griping fingers or rods 18. The stops 55 and 57 control how much of the available driving motion is used to open and close the rods 18 and should therefor be capable of withstanding the overriding force when a cam follower comes off of the respot cam and all of the spring force is transferred into one of the stops as will be well understood by those of ordinary skill in the art. This stop mechanism is easily accessible, easy to adjust, durable and operates at least as well or better than a conventional cast aluminum table.

The connecting crank arm 62 is then placed on the front of the table for accessibility. In addition, the third lever actuating arm 62*c* was added and the rotation about pivot 64 changed to counterclockwise when viewed from above. With these changes, it was possible to improve angles and increase moment arms to dramatically reduce the input forces required to drive the respot cells (not shown).

The foregoing description is provided for illustrative purposes only and should not be construed as in any way limiting this invention, the scope of which is defined solely by the appended claims.

I claim:

1. A pin table and actuating assembly for a bowling pin spotting device having a moving mechanism for raising and lowing a pin table, the pin table and actuating assembly comprising:

a substantially planar base member forming a plurality of opening therethrough, means attached to said base member extending across at least a part of each of the openings for releasably holding a plurality of bowling pins, actuating means including a cam link mechanism and a respot actuator crank arm having first and second respot actuator arms and an intermediate pivot fixed to and generally perpendicular to said base member, a first actuator arm connecting link connecting said first respot actuator arm to said cam link mechanism for rotating said respot actuator crank arm about said intermediate pivot in response to movement of said cam link mechanism, a second actuator arm connecting link connecting said second respot actuator arm to said means for releasably holding a plurality of bowling pins to thereby grasp and release the bowling pins in response to movement by said cam link mechanism and stop means for limiting the rotation of said respot actuator crank arm to thereby limit the movement of said means for releasably holding a plurality of bowling pins.

2. A pin table and actuating assembly for a bowling pin spotting device according to claim 1 in which each of said openings have a plurality of sides with at least one arcuate side.

3. A pin table and actuating assembly for a bowling pin spotting device according to claim 2, in which said means for releasably holding a plurality of bowling pins comprises a plurality of pairs of rods extending across each of the openings.

4. A pin table and actuating assembly for a bowling pin spotting device according to claim 2, in which said means for releasably holding a plurality of bowling pins comprises a plurality of pairs of fingers which extend at least partially across each of the openings.

5. A pin table and actuating assembly for a bowling pins spotting device having a moving mechanism for raising and lowering a pin table, the pin table and actuating assembly comprising:

a substantially planar sheet forming a plurality of opening therethrough with each of said openings having a plurality of sides with at least one arcuate side, means including a plurality of pairs of rods attached to said substantially planar sheet and extending across each of the openings for releasably holding a plurality of bowling pins, means connected to the plurality of pairs of rods for increasing and decreasing a distance between the two rods of each pair of rods, said means for increasing and decreasing the distance between the rods of each of the pair of rods including;

(a) a plurality of bellcranks, each bellcrank having a pivot body pivotally attached to said substantially planar sheet and first and second arms extending from the pivot body;

(b) a plurality of link members, each link member connected to the first arm of one bellcrank and at least one pair of rods; and, (c) an actuating link connected to the second arm of all of the bellcranks;

an actuating means including a cam link mechanism and a respot actuator crank arm having first and second respot actuator arms and an intermediate pivot fixed to and generally perpendicular to said substantially planar sheet, a first actuator arm connecting link connecting said first respot actuator arm to said cam link mechanism for rotating said respot actuator crank arm about said intermediate pivot in response to movement to said cam link mechanism, a second actuator arm connecting link connecting said second respot actuator arm to one of said plurality of bellcranks for increasing and decreasing the distance between said rods, and stop means for limiting the rotation of said respot actuator crank arms to thereby limit the movement of said rods.

6. A pin table and actuating assembly for a bowling pin spotting device according to claim 5 in which said stop means includes a pair of stop members disposed on said substantially planar sheet for engaging said first and second respot actuator arms.

7. A pin table and actuating assembly for a bowling pin spotting device according to claim 6 in which said stop means are adjustable.

8. A pin table and actuating assembly for a bowling pin spotting device according to claim 6 wherein said stop means provide for a rotation of said bellcranks through an angle of about 40°.

9. A pin table and actuating assembly for a bowling pin spotting device according to claim 8 in which one of said bellcranks includes a third lever arm intermediate of said first and second respot actuator arms and wherein said second actuator arm connecting link connects said second respot actuator arm to one of said bellcranks through said third lever arm.

* * * * *